US008863646B2

(12) United States Patent
Kabir

(10) Patent No.: US 8,863,646 B2
(45) Date of Patent: Oct. 21, 2014

(54) COMPRESSION SYSTEM HAVING SEAL WITH MAGNETIC COUPLING OF PISTONS

(75) Inventor: Omar M. Kabir, Waller, TX (US)

(73) Assignee: GE Oil & Gas Compression Systems, LLC, Houston, TX (US)

( * ) Notice: Subject to any disclaimer, the term of this patent is extended or adjusted under 35 U.S.C. 154(b) by 857 days.

(21) Appl. No.: 13/003,264

(22) PCT Filed: Jul. 31, 2009

(86) PCT No.: PCT/US2009/052385

§ 371 (c)(1),
(2), (4) Date: Jan. 7, 2011

(87) PCT Pub. No.: WO2010/027586

PCT Pub. Date: Mar. 11, 2010

(65) Prior Publication Data

US 2011/0138995 A1 Jun. 16, 2011

Related U.S. Application Data

(60) Provisional application No. 61/095,233, filed on Sep. 8, 2008.

(51) Int. Cl.

| | |
|---|---|
| ***F01B 9/00*** | (2006.01) |
| ***F04B 17/00*** | (2006.01) |
| ***F04B 53/14*** | (2006.01) |
| ***F04B 9/02*** | (2006.01) |

(52) U.S. Cl.

CPC . *F04B 9/02* (2013.01); *F04B 17/00* (2013.01); *F04B 53/144* (2013.01); *F04B 53/146* (2013.01); *Y10S 403/01* (2013.01)

USPC ..... 92/138; 92/140; 403/DIG. 1

(58) Field of Classification Search

USPC ..... 92/84, 88, 129, 138, 140; 403/DIG. 1

See application file for complete search history.

(56) References Cited

U.S. PATENT DOCUMENTS

| | | | |
|---|---|---|---|
| 4,120,618 | A | 10/1978 | Klaus |
| 4,197,474 | A | 4/1980 | Honigsbaum |

(Continued)

FOREIGN PATENT DOCUMENTS

| | | |
|---|---|---|
| DE | 3127893 | 2/1983 |
| EP | 0025562 | 3/1981 |

(Continued)

OTHER PUBLICATIONS

GB Examination Report on Application No. GB1104644.8, dated Nov. 13, 2012.

(Continued)

*Primary Examiner* — Michael Leslie

(74) *Attorney, Agent, or Firm* — Fletcher Yoder, P.C.

(57) ABSTRACT

A system, in certain embodiments, includes a barrier with magnetic coupling between opposite sides of the barrier. For example, the system may include a first member with a first magnet that translates along with the first member, and a second member having a second magnet that translates along with the second member. The system also may include the barrier completely isolating the first member from the second member, wherein the first magnet magnetically couples with the second magnet through the barrier to impart translational motion from the first member to the second member.

18 Claims, 7 Drawing Sheets

(56) References Cited

U.S. PATENT DOCUMENTS

| | | | | |
|---|---|---|---|---|
| 4,277,707 | A | 7/1981 | Silver et al. | |
| 5,292,284 | A | 3/1994 | Denk et al. | |
| 5,844,340 | A * | 12/1998 | Noda | 92/88 |
| 6,132,188 | A | 10/2000 | Brunee | |
| 6,205,906 | B1 * | 3/2001 | Suzuki et al. | 92/88 |
| 6,417,591 | B1 | 7/2002 | Saito et al. | |
| 6,499,907 | B1 * | 12/2002 | Baur | 403/DIG. 1 |
| 6,677,410 | B2 | 1/2004 | Williams | |
| 6,851,938 | B2 | 2/2005 | Ding et al. | |
| 7,029,246 | B2 | 4/2006 | Miller et al. | |
| 7,073,775 | B2 | 7/2006 | Kabir et al. | |
| 7,086,778 | B2 | 8/2006 | Terentiev | |
| 7,425,121 | B2 | 9/2008 | Wood et al. | |
| 7,439,702 | B2 | 10/2008 | Smith et al. | |
| 7,670,118 | B2 | 3/2010 | Sato | |
| 7,690,293 | B2 * | 4/2010 | Bensley et al. | 92/136 |
| 7,871,254 | B2 | 1/2011 | Ito | |
| 2003/0044285 | A1 | 3/2003 | Ding et al. | |
| 2004/0105767 | A1 | 6/2004 | Black et al. | |
| 2004/0265151 | A1 | 12/2004 | Bertram | |
| 2005/0206260 | A1 | 9/2005 | Akiyama | |
| 2006/0144387 | A1 | 7/2006 | Sato | |
| 2007/0108934 | A1 | 5/2007 | Smith et al. | |
| 2009/0062020 | A1 | 3/2009 | Edwards et al. | |
| 2011/0038737 | A1 | 2/2011 | Conry et al. | |

FOREIGN PATENT DOCUMENTS

| | | | |
|---|---|---|---|
| EP | 1310677 | | 5/2003 |
| EP | 1420164 | | 5/2004 |
| EP | 1596071 | | 11/2005 |
| EP | 1693570 | | 8/2006 |
| GB | 2347716 | A | 9/2000 |
| WO | 2009154880 | A1 | 12/2009 |

OTHER PUBLICATIONS

SG Written Opinion for Application No. 201101082-4, dated Feb. 3, 2012.

PCT Search Report and Written Opinion for PCT/US2009/052385 mailed Apr. 12, 2009.

Lesson Learned From Natural Gas STAR Partners; Article Entitled Replacing Wet Seals with Dry Seals in Centrifugal Compressors; Nov. 2003; pp. 1-12.

Dexter Magnetic Technologies; Magnetic Couplings; http://www.dextermag.com/products_magneticapplications.aspx?id=110; printed Feb. 4, 2008; 2 pages.

Dexter Magnetic Technologies; Permanent Magnet Materials; http://www.dextermag.com/products_magneticmaterials.aspx?id=61&; printed Feb. 4, 2008; 1 page.

SG Written Opinion for Application No. 201101082-4, dated Jan. 19, 2012.

* cited by examiner

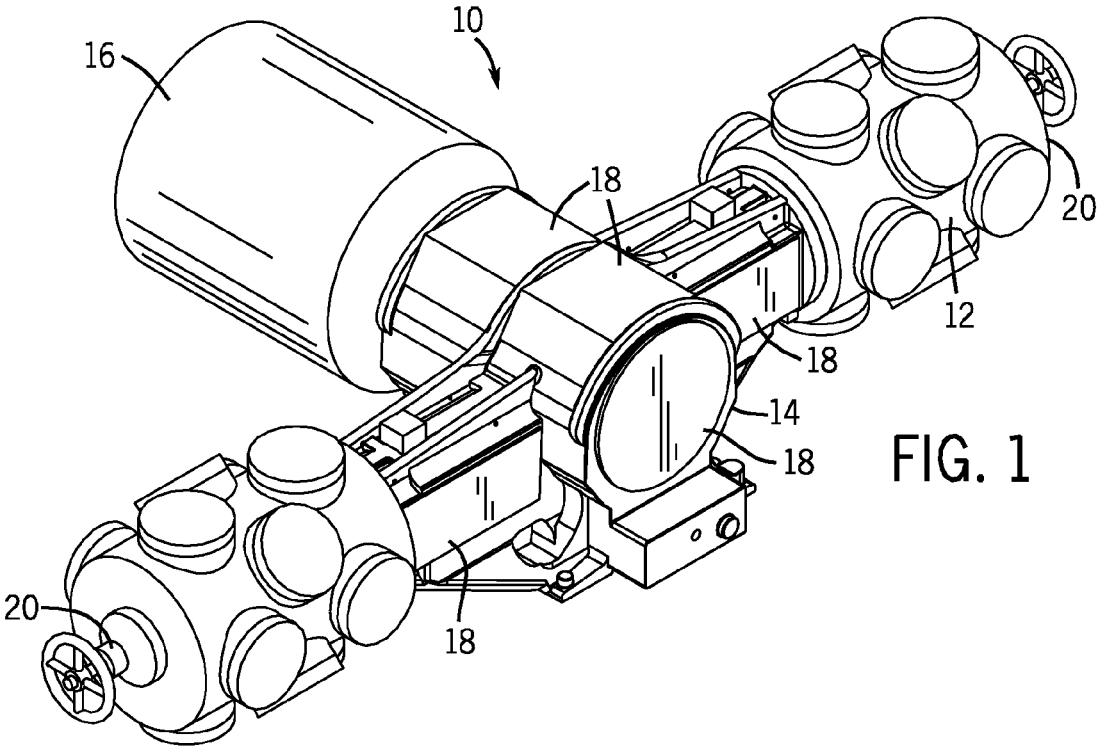
FIG. 1
FIG. 2
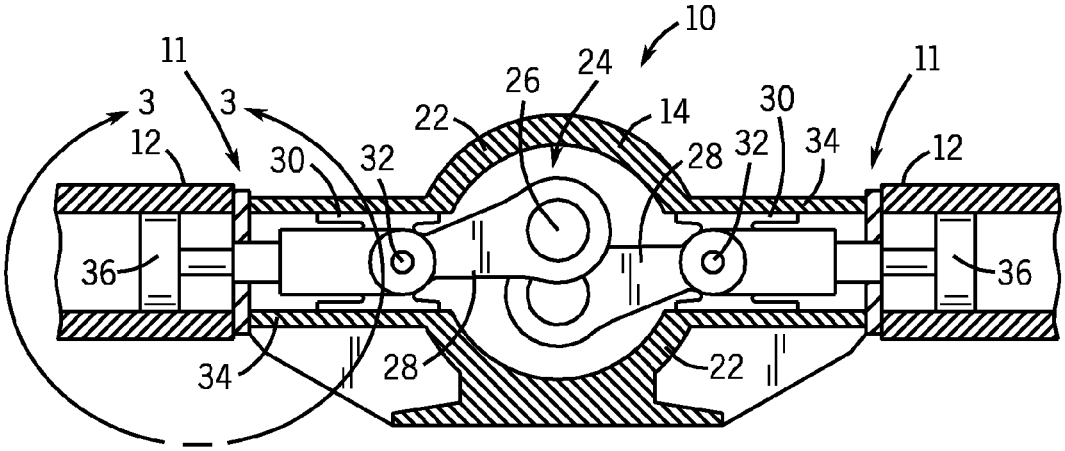

COMPRESSION SYSTEM HAVING SEAL WITH MAGNETIC COUPLING OF PISTONS

CROSS-REFERENCE TO RELATED APPLICATIONS

This application claims priority to and benefit of PCT Patent Application No. PCT/US2009/052385, entitled "Compression System Having Seal with Magnetic Coupling of Pistons," filed Jul. 31, 2009, which is herein incorporated by reference in its entirety, and which claims priority to and benefit of U.S. Provisional Patent Application No. 61/095,233, entitled "Compression System Having Seal with Magnetic Coupling of Pistons", filed on Sep. 8, 2008, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

A variety of industrial and commercial applications use natural gas as a source of power and/or heat. For instance, a combustion engine may use natural gas to provide mechanical power to drive wheels, electrical generators, and other machinery. A furnace or appliance (e.g., a laundry machine) may use natural gas as a source of heat. A manufacturing process may use natural gas in the manufacture of an array of products and materials, including glass, steel, and plastics, for example. Thus, a high demand exists for natural gas. Companies often spend a significant amount of time and resources in the search, extraction, and transportation of natural gas. For example, equipment may extract natural gas from an oil field, and transport the natural gas to a remote facility. Typically, the equipment includes a compressor to facility the transportation process.

A reciprocating compressor is one type of compressor that is suitable for such applications, among others. A reciprocating compressor is a positive-displacement device, which utilizes a motor to drive one or more pistons via a crankshaft and connecting rods. Each piston reciprocates back and forth in a cylinder to intake a gas into a chamber, compress the gas within the chamber, and exhaust the gas from the chamber to a desired output. Unfortunately, existing reciprocating compressors are prone to leakage of the gas into internal components, e.g., the crankshaft. Such leakage causes undesirable corrosion and wear of the internal components.

One leakage reduction technique involves the use of seals and packing assemblies. For example, existing reciprocating compressors include multiple seals and packing assemblies to block the gas in the chamber from leaking into other internal components, e.g., the crankshaft. Such seals and packing assemblies are typically mounted around the piston's rod. Unfortunately, these seals and packing assemblies are prone to leakage, which generally increases with wear of the reciprocating compressor. Furthermore, these seals and packing assemblies add friction and, thus, heat to the moving components. As a result, the packing assemblies generally require a lubrication system and a cooling system, which adds further to the technical challenge, cost, and size to the reciprocating compressors.

Another leakage reduction technique involves the use of an intermediate section between the crankshaft and the pistons. The intermediate section (known as an auxiliary distance piece) may be pressurized to resist leakage of the gas into the internal components of the reciprocating compressor. The intermediate section also may be purged to release leaked gas. Unfortunately, the intermediate section cannot completely prevent gas from leaking into the internal components of the reciprocating compressor. The intermediate section also increases the size, weight, and potential vibration of the reciprocating compressor. For example, the intermediate section results in a larger footprint of the reciprocating compressor, a longer connecting rod between the crankshaft and each piston, and so forth.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 1 is a perspective view of a reciprocating compressor including an exemplary packing-free magnetic coupling in accordance with an embodiment of the present invention;

FIG. 2 is an axial cross-sectional view of the exemplary compressor of FIG. 1, illustrating internal components of the compressor, including the packing-free magnetic coupling, in accordance with an embodiment of the present invention;

DETAILED DESCRIPTION OF SPECIFIC EMBODIMENTS

Figure 3:
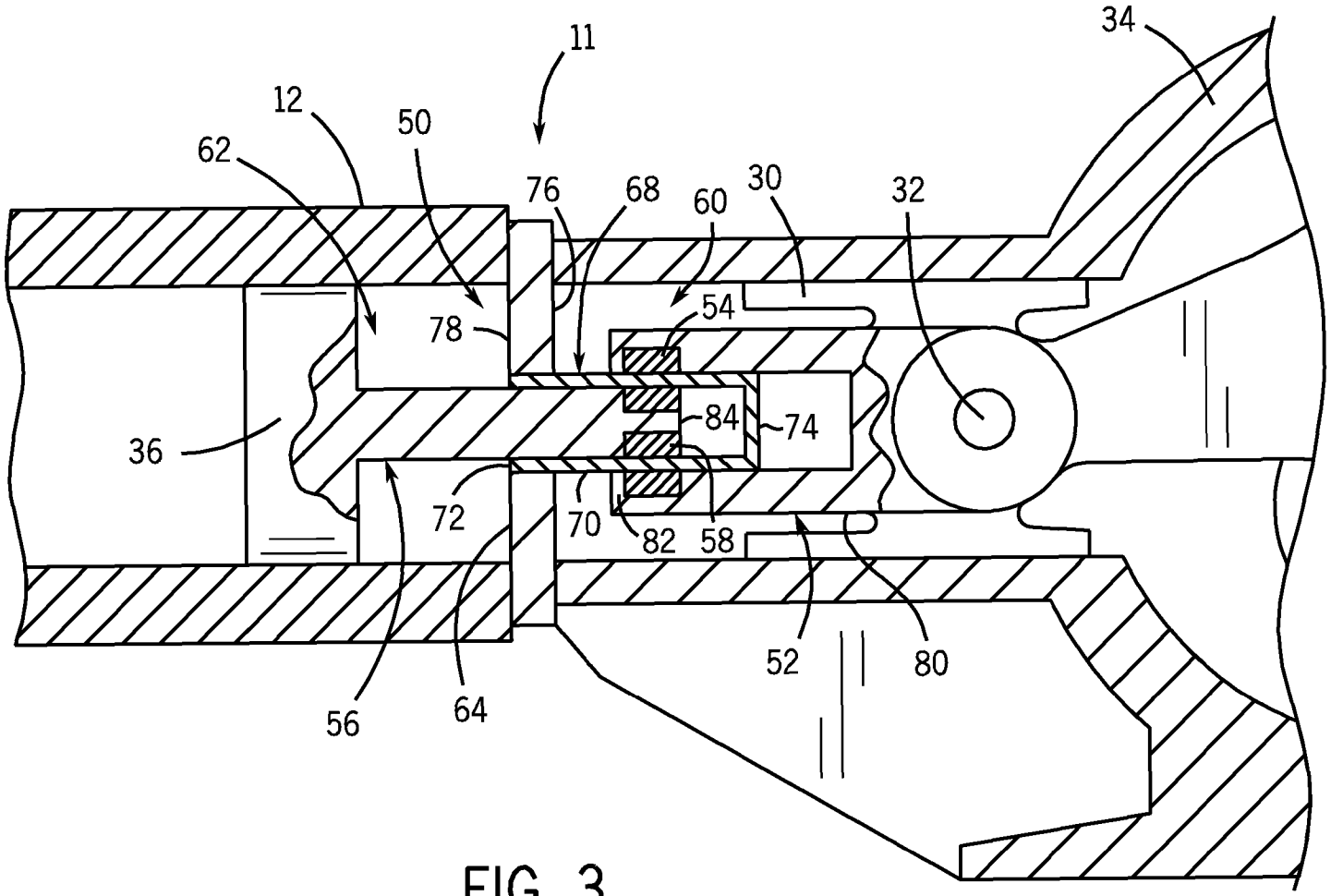
FIG. 3 is a partial axial cross-sectional view taken within line 3-3 of FIG. 2, further illustrating details of the packing-free magnetic coupling in accordance with an embodiment of the present invention.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

As discussed in detail below, the disclosed embodiments employ magnets to couple moving components between different regions in a system. For example, the magnets may enable the transfer of translational, rotational, or other complex motions between completely separate components. As a result, the disclosed embodiments may employ a barrier between the separate components, such that the different regions housing these separate components are completely isolated from one another. In other words, the barrier may be described as a permanent or fixed blockade that is completely sealed off without any moving seals, packing assemblies, or the like. For example, instead of using an annular seal (e.g., an o-ring) between a shaft and a surrounding housing, the shaft is divided into two opposing shafts, a magnet (e.g., permanent magnet, electromagnet, an active magnet, or a combination thereof) is coupled to each opposing shaft, a barrier is placed between the two opposing shafts and associated magnets, and the two opposing shafts move with respect to one another via the magnetic forces. The barrier itself does not require a tight interface with each of these components (e.g., opposing shafts) to create a seal, because the barrier permanently and completely isolates the components from one another. As a result, a looser fit is possible between the barrier and magnetically coupled components (e.g., opposing shafts), thereby reducing friction, wear, heat, and general constraints on speed. In turn, the system can eliminate complex lubrication and cooling systems typically associated with moving seals, and the system can operate at higher speeds for improved performance. The system can also eliminate special gas pressurizing and/or purging chambers typically used to address leakage. Thus, in certain embodiments, the use of a barrier along with opposite magnetic couplings may be described as a seal-free magnetic coupling or a packing-free magnetic coupling.

Although the disclosed embodiments may be used in a variety of systems and methods, they may be particularly useful where motion is desired between different regions that need to be sealed off from one another. For example, the disclosed embodiments may be employed in a variety of engine-driven systems, such as compressors and pumps, in a myriad of industries. One particularly useful industry is the oil and gas industry, where the disclosed embodiments may be useful in various oil and gas equipment. For example, one embodiment of a compression system includes a motor, a crankshaft rotatable by the motor, a first reciprocal shaft coupled to the crankshaft and having a first annular magnet, a second reciprocal shaft having a second annular magnet, a piston coupled to the second reciprocal shaft, and a gas compression chamber disposed adjacent the piston. In this embodiment, the compression system also may include a can-shaped barrier in a fixed position that isolates the first and second reciprocal shafts, wherein the can-shaped barrier completely blocks gas from leaking from the gas compression chamber to an opposite side having the first reciprocal shaft. In this embodiment, the first annular magnet magnetically couples with the second annular magnet through an annular wall of the can-shaped barrier to impart reciprocal motion from the first reciprocal shaft to the second reciprocal shaft. Although this embodiment is merely one possible application of the seal-free magnetic coupling, it illustrates a particular application that gains many benefits over existing techniques that require multiple seals, packing assemblies, and intermediate pressurized and/or purging chambers. The following discussion focuses on a compression system for illustrative purposes only, and is not intended to limit the disclosed embodiments to any particular application.

Turning now to the figures, an exemplary compressor 10 is provided in FIG. 1. As discussed in detail below, the compressor 10 may include one or more seal-free magnetic couplings or packing-free magnetic couplings 11 having unique isolating features and magnetic coupling features between different components and regions internal to the compressor 10. In the presently illustrated embodiment, the compressor 10 includes a pair of compression cylinders 12 coupled to a frame 14. As discussed in greater detail below, a variety of internal components may be disposed within the cylinders 12 and the frame 14 to enable compression of fluids introduced into the compressor 10 the cylinders 12. In one embodiment, the compressor 10 may be utilized to compress natural gas. However, in other embodiments, the compressor 10 may be configured and/or utilized to compress other fluids.

A mechanical power source or driver 16, such as an engine or an electric motor, may be coupled to the compressor 10 to provide mechanical power to the various internal components and enable compression of the fluid within the cylinders 12. To facilitate access to such internal components, as may be desired for diagnostic or maintenance purposes, openings in the frame 14 may be provided and selectively accessed via removable covers 18. Further, the cylinders 12 may also include valve assemblies 20 for controlling flow of the fluid through the cylinders 12.

It will be appreciated that, although the exemplary compressor 10 is illustrated as a two-throw reciprocating compressor, other compressor configurations may also employ and benefit from the presently disclosed techniques. For instance, in other embodiments, the compressor 10 may include a different number of cylinder throws, such as a four-throw compressor, a six-throw compressor, a couple-free reciprocating compressor, a screw compressor, or the like. Further, other variations are also envisaged, including variations in the length of stroke, the operating speed, and the size, to name but a few.

A cross-sectional view of the exemplary compressor 10 is provided in FIG. 2, which illustrates a number of exemplary internal components of the compressor 10 of FIG. 1. In particular, as described further below, FIG. 2 illustrates an embodiment of compressor 10 with the seal-free magnetic couplings 11. In the presently illustrated embodiment, the frame 14 of the exemplary compressor 10 includes a hollow central body or housing 22 that generally defines an interior volume 24 in which various internal components may be received, such as a crankshaft 26. In one embodiment, the central body 22 may have a generally curved or cylindrical shape. It should be noted, however, that the central body 22 may have other shapes or configurations in full accordance with the disclosed embodiments.

In operation, the driver 16 rotates the crankshaft 26 supported within the interior volume 24 of the frame 14. In one embodiment, the crankshaft 26 is coupled to crossheads 30 via connecting rods 28 and pins 32. The crossheads 30 are disposed within crosshead guides 34, which generally extend from the central body 22 and facilitate connection of the cylinders 12 to the compressor 10. In one embodiment, the compressor 10 includes two crosshead guides 34 that extend generally perpendicularly from opposite sides of the central body or housing 22, although other configurations are also envisaged. As may be appreciated, the rotational motion of the crankshaft 26 is translated via the connecting rods 28 to reciprocal linear motion of the crossheads 30 within the crosshead guides 34.

As noted above, the cylinders 12 are configured to receive a fluid for compression. The crossheads 30 are coupled to pistons 36 disposed within the cylinders 12, and the reciprocating motion of the crossheads enables compression of fluid within the cylinders 12 via the pistons 36. Particularly, as a piston 36 is driven forward (i.e., outwardly from central body 22) into a cylinder 12, the piston 36 forces the fluid within the cylinder into a smaller volume, thereby increasing the pressure of the fluid. A discharge valve of valve assembly 20 may then be opened to allow the pressurized or compressed fluid to exit the cylinder 12. The piston 36 may then stroke backward, and additional fluid may enter the cylinder 12 through an inlet valve of the valve assembly 20 for compression in the same manner described above.

FIG. 3 is a partial axial cross-sectional view taken along line 3-3 of FIG. 2, further illustrating details of the packing-free magnetic coupling 11 in accordance with certain embodiments of the present invention. As illustrated, the packing-free magnetic coupling 11 provides a magnetic coupling with complete isolation between the crosshead 30 and the piston 36. The illustrated coupling 11 includes a barrier 50, a first reciprocating shaft 52 having a first annular magnet (e.g., a single magnet or plurality of magnets) 54, and a second reciprocating shaft 56 having a second annular magnet (e.g., a single magnet or a plurality of magnets) 58. Although reference is made to annular geometries, the disclosed embodiments include other geometries in a coaxial or concentric arrangement that enables axial movement. For example, the barrier 50, the shafts 52 and 54, and the associated magnets 54 and 58 may be any geometry that enables axial movement in a telescopic or concentric arrangement, e.g., annular and non-annular. For example, the parts of the coupling 11 may interface one another along interfaces that are annular, triangular, square, rectangular, pentagonal, hexagonal, octagonal, oval, and so forth. Thus, any mention of annular is also intended to include any other geometry that enables such axial reciprocating movement.

The barrier 50 is configured to provide complete isolation between first and second volumes or regions 60 and 62 disposed on opposite sides of the barrier 50. For example, the barrier 50 may be defined as a continuous wall without any moving seals, packing assemblies, or the like, in contact with moving portions of the first and second reciprocating shafts 52 and 56. The illustrated barrier 50 is generally fixed in position, and may have relatively loose clearances or gaps relative to the first and second reciprocating shafts 52 and 56. Thus, in the illustrated embodiment, the first and second reciprocating shafts 52 and 56 do not directly seal against surfaces of the barrier 50. The barrier 50 may be a single integrated wall (e.g., one-piece), a plurality of walls fixedly coupled together (e.g., welded together), or a plurality of walls removably coupled together (e.g., bolted together).

As illustrated in FIG. 3, the barrier 50 includes a generally planar wall 64 disposed crosswise relative to an axis 66 of the crosshead guide 34. The barrier 50 also includes a can-shaped barrier 68, which includes an annular wall 70, an open end 72, and an opposite closed end 74. As illustrated, the can-shaped barrier 68 extends along the axis 66 from the planar wall 64 into the first volume or region 60. More specifically, the can-shaped barrier 68 extends through the planar wall 64 between opposite first and second sides 76 and 78, wherein the open end 72 is generally flush with the second side 78 of the planar wall 64. Thus, the open end 72 faces the second volume or region 62, while the annular wall 70 with the closed end 74 is disposed within the first volume or region 60. The can-shaped barrier 68 may be coupled to the planar wall 64 via a welded joint, a flange with bolts, a threaded connection, or a variety of other mounting techniques. However, a weld, a braze, or another permanent connection between components of the barrier 50 may improve the isolation between the first and second volumes or regions 60 and 62.

The packing-free magnetic coupling 11, as illustrated in FIG. 3, has a coaxial or concentric arrangement of the first reciprocating shaft 52, the second reciprocating shaft 56, and the can-shaped barrier 68 of the barrier 50. As illustrated, the first reciprocating shaft 52 extends along the axis 66 away from the crosshead 30 toward the planar wall 64. The first reciprocating shaft 52 has a hollow annular wall 80 that extends about (i.e., surrounds) the annular wall 70 of the can-shaped barrier 68. In addition, the hollow annular wall 80 includes the first annular magnet 54 at a first end portion 82. The first annular magnet 54 may include one or more sections that define an annular form that is coaxial with the can-shaped barrier 68 and the second annular magnet 58. The first annular magnet 54 may include a permanent magnet, an electromagnet, or a combination thereof.

The second reciprocating shaft 56, as illustrated in FIG. 3, extends along the axis 66 from the piston 36 toward the planar wall 64. In particular, the illustrated shaft 56 extends though the open end 72 and lengthwise into the annular wall 70 of the can-shaped barrier 68 in a coaxial or concentric arrangement with both the can-shaped barrier 68 and the first reciprocating shaft 52. In the illustrated embodiment, the second reciprocating shaft 56 is solid and the second annular magnet 58 is disposed at a second end portion 84. However, embodiments of the second reciprocating shaft 56 may include a partially or entirely hollow body with one or more magnets defining the second annular magnet 58. For example, the second annular magnet 58 may include a plurality of magnets disposed about the circumference of the second reciprocating shaft 56. Again, like the first annular magnet 54, the second annular magnet 58 may include a permanent magnet, an electromagnet, or a combination thereof.

The packing-free magnetic coupling 11, as illustrated in FIG. 3, enables complete isolation between the first and second volumes or regions 60 and 62, while enabling transfer of motion from the first reciprocating shaft 52 to the second reciprocating shaft 56 via the magnetic coupling between the first and second annular magnets 54 and 58. As illustrated in FIG. 3, the first and second annular magnets 54 and 58 are generally aligned with one another in an annular or coaxial arrangement. In other words, the magnetic attraction between the first and second annular magnets 54 and 58 ensures that these magnets 54 and 58 and their attached shafts 52 and 56 move in unison with one another despite the isolation provided by the barrier 50. Thus, as the first reciprocating shaft 52 moves to the left along the axis 66, the magnetic coupling between the first and second annular magnets 54 and 58 causes the second reciprocating shaft 56 to also move left along the axis 66. During this movement, the barrier 50 remains completely fixed in position, and no seals are required along the moving shafts 52 and 56 to block leakage between the first and second volumes or regions 60 and 62. With sufficiently strong magnets, the response between the first and second reciprocating shafts 52 and 56 should be relatively immediate with no lag time. In other words, the first and second reciprocating shafts 52 and 56 may move as if they are directly coupled with one another, yet they are completely isolated by the barrier 50 and move with one another only via the magnetic coupling.

Accordingly, the packing-free magnetic coupling 11 is able to eliminate typical seals, packing assemblies, and the like that directly interface with the moving shafts 52 and 56, thereby drastically reducing frictional forces, heat generation, and restrictions on operational speeds. The complete isolation provided by the packing-free magnetic coupling 11 also may eliminate the need for any type of intermediate chamber with a pressurized gas to resist leaks and/or a purging system to release leaked gases due to gas leakage from the second volume or region 62 to the first volume or region 60. Again, the barrier 50 provides complete isolation between these regions 60 and 62. Although FIGS. 2 and 3 illustrate one possible embodiment of the packing-free magnetic coupling 11, it may have a variety of forms and features within the scope of the present invention.

Figure 4:
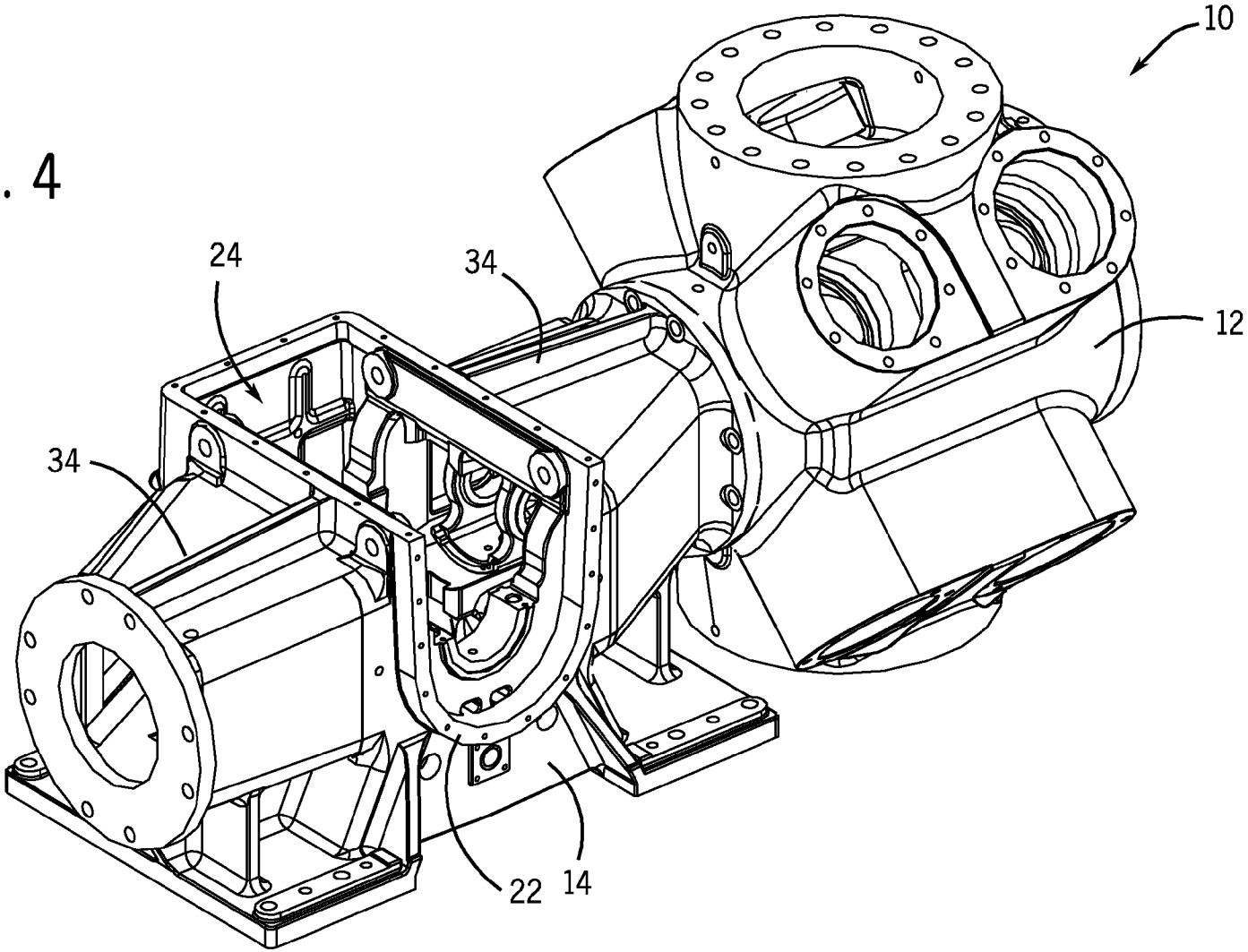
FIG. 4 is a partial perspective view of an alternative embodiment of a compressor including an exemplary packing-free magnetic coupling.

FIGS. 4-8 illustrate another embodiment of the compressor 10 having the packing-free magnetic coupling 11. FIG. 4 is a partial perspective view of the compressor 10 in accordance with certain embodiments of the present invention. As illustrated, the compressor 10 includes the cylinder 12 coupled to the frame 14. Various components and covers are removed from the compressor 10 as illustrated in FIG. 4. However, the compressor 10 includes a variety of similar components as discussed above with reference to FIGS. 1-3. For example, the frame 14 includes the central body 22 with the interior volume 24, which houses the crank shaft 26. In addition, the central body 22 is coupled to a pair of crosshead guides 34, which lead to respective cylinders 12. Similar to the embodiment of FIGS. 1-3, the packing free magnetic coupling 11 may be disposed in the region between the crosshead guides 34 and the respective cylinders 12.

Figure 5:
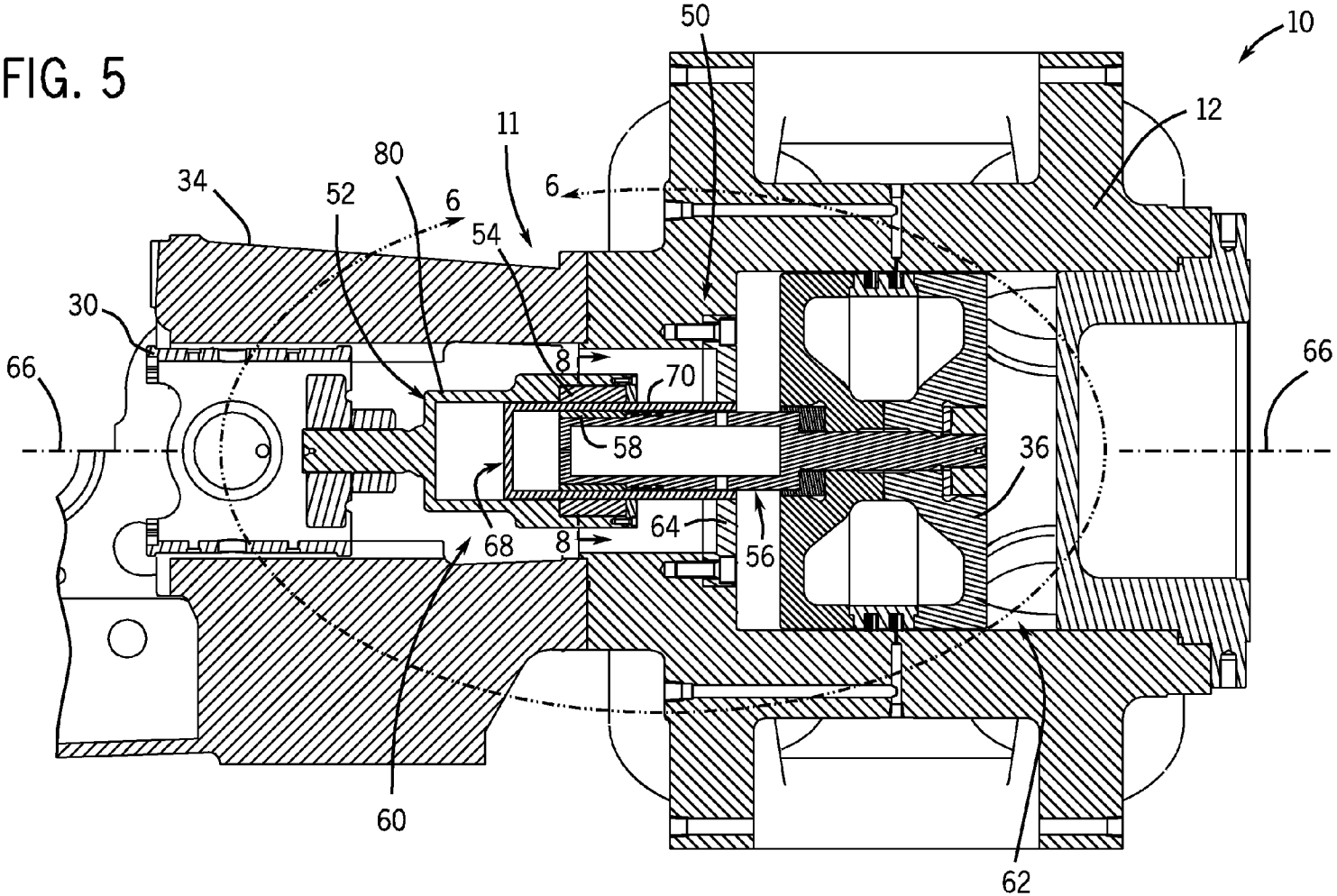
FIG. 5 is a partial axial cross-sectional view of the exemplary compressor of FIG. 4, illustrating internal components of the compressor, including the packing-free magnetic coupling, in accordance with an embodiment of the present invention.

FIG. 5 is a partial axial cross-sectional view of the compressor 10 as illustrated in FIG. 4, further illustrating details of the packing free magnetic coupling 11. In the illustrated embodiment, the packing free magnetic coupling 11 includes the barrier 50, the first reciprocating shaft 52 having the first annular magnet 54, and the second reciprocating shaft 56 having the second annular magnet 58. Similar to the embodiment of FIGS. 1-3, the packing-free magnetic coupling 11 of FIG. 5 has annular components disposed in a concentric or coaxial arrangement, wherein the components move in a telescopic arrangement relative to one another to transfer translational motion from one side to another of the barrier 50. In particular, the first reciprocating shaft 52 includes the hollow annular wall 80, which extends concentrically about the can-shaped barrier 68 of the barrier 50. Likewise, the second reciprocating shaft 56 extends coaxially or concentrically within the can-shaped barrier 68. In this coaxial or concentric arrangement, the first reciprocating shaft 52 positions the first annular magnet 54 in axial alignment about the second annular magnet 58 disposed on the second reciprocating shaft 56. Again, the can-shaped barrier 68 has the annular wall 70 extending between the first and second annular magnets 54 and 58, yet the magnets 54 and 58 are magnetically coupled together through the annular wall 70.

Thus, as the first reciprocating shaft 52 is driven in a rightward direction along the axis 66, the magnetic coupling between first and second annular magnets 54 and 58 causes the second reciprocating shaft 56 to also move in a rightward direction along the axis 66. In turn, the second reciprocating shaft 56 drives the piston 36 in a rightward direction along the axis 66 to cause compression of a gas. In a similar manner, a leftward motion of the first reciprocating shaft 52 along the axis 66 causes an equal leftward motion of the second reciprocating shaft 56 along the axis 66 via the magnetic coupling between the first and second annular magnets 54 and 58. As illustrated in FIG. 5, the first and second reciprocating shafts 52 and 56 and associated magnets 54 and 58 are disposed in an intermediate position between a leftmost position and a rightmost position along the axis 66. In other words, the shafts 52 and 56 are in the middle of a compression or intake stroke.

Figure 6:
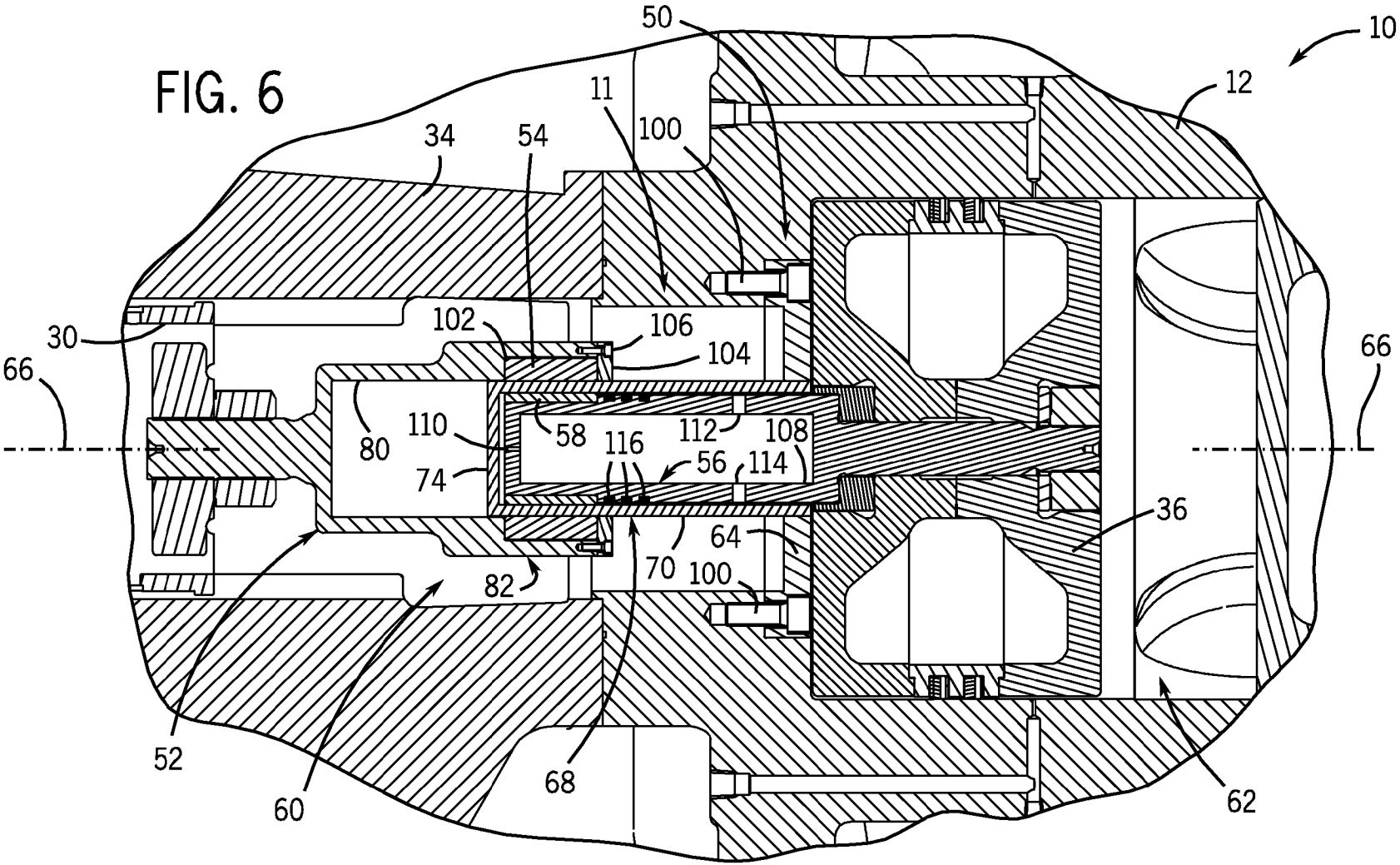
FIG. 6 is a partial axial cross-sectional view taken within line 6-6 of FIG. 5, illustrating a fully retracted position of the packing-free magnetic coupling in accordance with an embodiment of the present invention.
Figure 7:
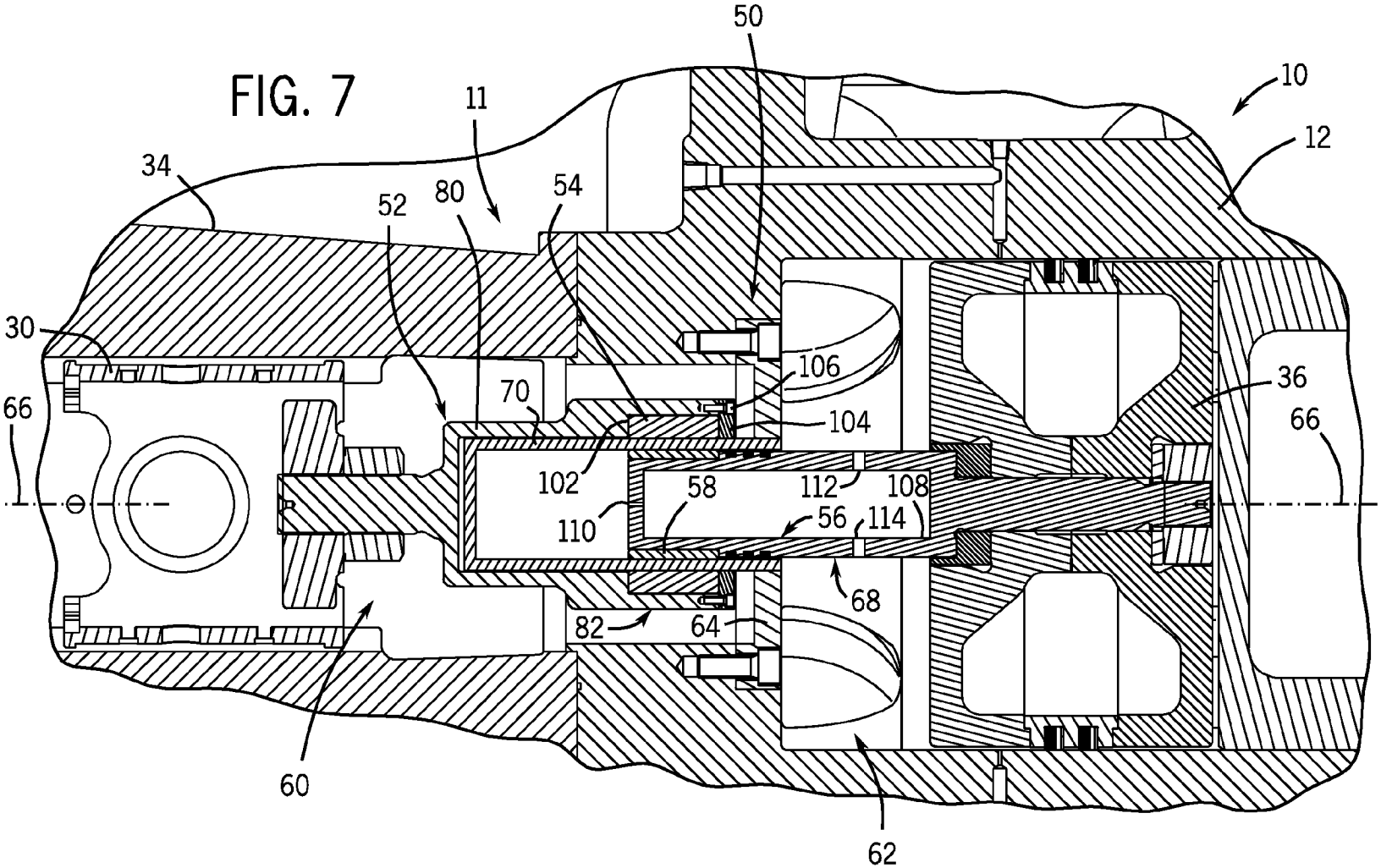
FIG. 7 is a partial axial cross-sectional view taken within line 6-6 of FIG. 5, further illustrating a fully withdrawn position of the packing-free magnetic coupling in accordance with an embodiment of the present invention.

FIGS. 6 and 7 are partial axial cross-sectional views taken within line 6-6 of FIG. 5, further illustrating opposite end positions along a range of movement of the packing-free magnetic coupling 11 in accordance with an embodiment of the present invention. For example, FIG. 6 illustrates a leftmost position of the first and second reciprocating shafts 52 and 56, such that the piston 36 is fully retracted for gas intake prior to a compression stroke. In contrast, FIG. 7 illustrates first and second reciprocating shafts 52 and 56 in a rightmost position, such that the piston 36 is at the end of a compression stroke. With reference to both FIGS. 6 and 7, the illustrated packing free magnetic coupling 11 may have a variety of additional features in accordance with certain embodiments of the present invention. For example, the illustrated barrier 50 includes the planar wall 64 and the can-shaped barrier 68, which may be collectively coupled to the cylinder 12 and/or crosshead guide 34 via a plurality of bolts 100. However, in certain embodiments, the barrier 50 may be directly welded or permanently secured to the cylinder 12 and/or crosshead guide 34. Similarly, the planar wall 64 and the can-shaped barrier 68 may be permanently fixed to one another via welding, or may be removably coupled together via bolts, threads, or the like.

In certain embodiments, the can-shaped barrier 68 may be made of a non-magnetic material, such as a carbon composite, titanium, or 304 stainless steel. The non-magnetic composition of the can-shaped barrier 68 facilitates the magnetic coupling between the first and second annular magnets 54 and 58. Thus, a variety of other non-magnetic materials are also within the scope of the disclosed embodiments.

As further illustrated in FIGS. 6 and 7, the first reciprocating shaft 52 has a hollow annular wall 80 leading to the first annular magnet 54 at the first end portion 82. The first annular magnet 54 may be permanently or removably disposed within the first end portion 82 of the first reciprocating shaft 52. As illustrated, the first annular magnet 54 is secured within an annular cavity 102 via an end flange 104 and a plurality of bolts 106 coupled to the first end portion 82. In certain embodiments, the first reciprocating shaft 52, including the hollow annular wall 80 and the end flange 104, may be made of a non-magnetic material similar to the can-shaped barrier 68. For example, an embodiment of the first reciprocating shaft 52 may be made of a carbon composite, titanium, or 304 stainless steel. Again, the non-magnetic material may facilitate the magnetic coupling between the first and second magnets 54 and 58.

The second reciprocating shaft 56, as illustrated in FIGS. 6 and 7, also may be made of a non-magnetic material, such as a carbon composite, titanium, or 304 stainless steel. In addition, the illustrated shaft 56 may have a hollow construction with vents to facilitate the reciprocal motion in and out of the can-shaped barrier 68. In particular, the illustrated shaft 56 may have a generally closed hollow body 108 with an end vent 110 and lateral vents 112 and 114. As appreciated, the hollow body 108 and vents 110, 112, and 114 are configured to enable fluid flow through the second reciprocating shaft 56 as it moves in and out of the can-shaped barrier 68, thereby reducing any potential pressure resistance to the reciprocal motion. In certain embodiments, the second reciprocating shaft 56 may include one or more rod rings 116 disposed about the shaft 56 within the can-shaped barrier 68. However, these rod rings 116 are not intended to provide any sealing functionality, as the barrier 50 completely isolates the first volume or region 60 from the second volume or region 62.

Figure 8:
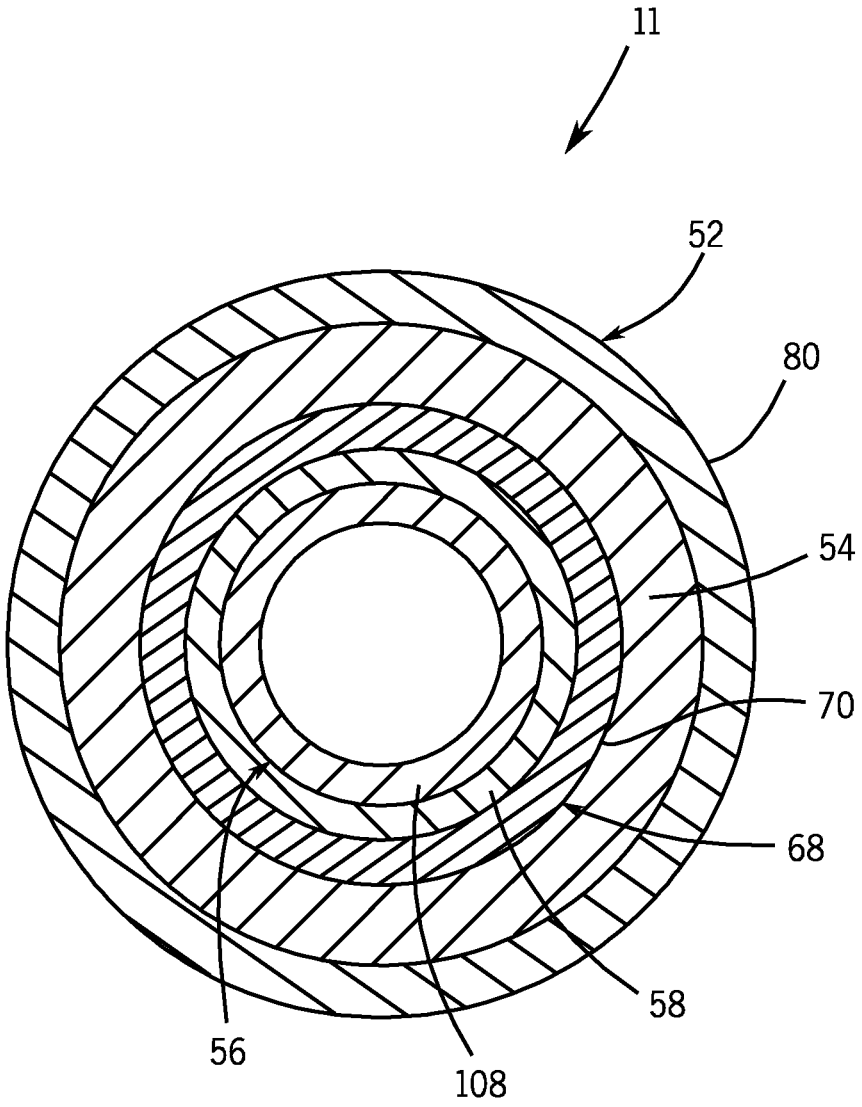
FIG. 8 is a cross-sectional view taken through line 8-8 of FIG. 5, further illustrating a co-axial or concentric arrangement of a barrier disposed between reciprocating components of the packing free magnetic coupling in accordance with an embodiment of the present invention.

FIG. 8 is a cross-sectional view of the coaxial or concentric arrangement of the packing free magnetic coupling 11 taken along line 8-8 of FIG. 5. In general, the cross-sectional view of the shafts, magnets, barriers and associated components could be any shape (e.g., annular or non-annular) in a generally coaxial or concentric arrangement. In other words, a variety of shapes may be used to enable axial movement in a coaxial or concentric arrangement, e.g., duplicative shapes that encapsulate one another as generally shown in the arrangement of FIG. 8. For example, the parts may be annular or non-annular, such as square, rectangular, triangular, polygonal, hexagonal, pentagonal, octagonal, and so forth.

In particular, FIG. 8 illustrates the completely separate positions of the first and second reciprocating shafts 52 and 56 and associated magnets 54 and 58 on opposite sides of the can-shaped barrier 68. As illustrated, the annular wall 70 of the canned-shaped barrier 68 is disposed directly between the first and second annular magnets 54 and 58. In turn, the first and second reciprocating shafts 52 and 56 are disposed about the first and second annular magnets 54 and 58. As discussed above, the components surrounding the first and second annular magnets 54 and 58 may be made of a non-magnetic material, such as a carbon composite, titanium, or 304 stainless steel.

As discussed above with reference to FIGS. 1-8, the packing free magnetic coupling 11 uses magnetic attraction between magnets to transfer motion across a barrier. The motion may include translational and/or reciprocal motion as described above, or the motion may include rotation. For example, the motion may include any combination of linear motion, rotational motion, reciprocating motion, and so forth. The magnetic coupling may be used with or without a barrier (e.g., barrier 50) in between. Furthermore, the motion may be in any orientation relative to a barrier, e.g., parallel, perpendicular, coaxial, and so forth.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a compressor;

a crankshaft;

a motor coupled to the crankshaft;

a first member coupled to the crankshaft, wherein the first member comprises a first magnet that translates along with the first member;

a piston;

a second member coupled to the piston, wherein the second member comprises a second magnet that translates along with the second member; and a barrier completely isolating the first member from the second member, wherein the first magnet magnetically couples with the second magnet through the barrier to impart translational motion from the first member to the second member.

2. The system of claim 1, wherein the first member comprises a shaft and the second member comprises the piston.

3. The system of claim 1, wherein the first member, the second member, and the barrier are disposed in a concentric arrangement about one another.

4. The system of claim 3, wherein the first member is disposed concentrically about the barrier, and the barrier is disposed concentrically about the second member.

5. The system of claim 4, wherein the first magnet comprises a first annular magnet, and the second magnet comprises a second annular magnet.

6. The system of claim 1, wherein the first and second magnets each comprise a permanent magnet, an electromagnet, an active magnet, or a combination thereof.

7. The system of claim 1, wherein the first and second members each comprise hollow annular portions.

8. The system of claim 1, wherein the barrier is completely seal-free between opposite sides of the barrier.

9. A system, comprising:

a first reciprocating member having a first magnet, wherein the first magnet is configured to transfer reciprocal motion of the first reciprocating member to a second reciprocating member via a second magnet coupled to the second reciprocating member, and wherein the first reciprocating member comprises a connecting rod configured to couple with a crankshaft.

10. The system of claim 9, wherein the first magnet is configured to magnetically couple with the second magnet through a barrier that completely isolates the first and second reciprocating members.

11. The system of claim 10, comprising the barrier, wherein the barrier has a can-shaped geometry.

12. The system of claim 9, wherein the first member comprises a piston.

13. The system of claim 9, wherein the first reciprocating member and the first magnet are configured to be in a concentric arrangement with the second reciprocating member and the second magnet during the reciprocal motion.

14. A system, comprising:

a magnetic coupling barrier configured to completely isolate first and second members on opposite sides of the magnetic coupling barrier, wherein the magnetic coupling barrier is configured to enable magnetic coupling and transfer of translation motion between first and second magnets coupled to the respective first and second members, and wherein the magnetic coupling barrier comprises a can-shaped geometry having an annular wall and a closed end, and the magnetic coupling occurs through the annular wall, the closed end, or a combination thereof.

15. The system of claim 14, wherein the magnetic coupling barrier is completely seal-free between the opposite sides.

16. The system of claim 14, comprising a machine having the magnetic coupling barrier.

17. A system, comprising:

a drive;

a crankshaft coupled to the drive, wherein the drive is configured to rotate the crankshaft;

a first reciprocal shaft coupled to the crankshaft, wherein the first reciprocal shaft comprises a first annular magnet;

a second reciprocal shaft having a second annular magnet;

a piston coupled to the second reciprocal shaft;

a gas compression chamber disposed adjacent the piston; and a can-shaped barrier in a fixed position that isolates the first and second reciprocal shafts, wherein the can-shaped barrier completely blocks gas from leaking from the gas compression chamber to an opposite side having the first reciprocal shaft, the first annular magnet magnetically couples with the second annular magnet through an annular wall of the can-shaped barrier to impart reciprocal motion from the first reciprocal shaft to the second reciprocal shaft.

18. The system of claim 14, wherein the first member comprises a connecting rod configured to couple with a crankshaft.

* * * * *